US011103926B1

(12) United States Patent
Ferrando et al.

(10) Patent No.: US 11,103,926 B1
(45) Date of Patent: Aug. 31, 2021

(54) SYNTHESIS OF AN INTERMETALLIC COMPOUND POWDER

(71) Applicant: The United States of America, as represented by the Secretary of the Navy, Arlington, VA (US)

(72) Inventors: William A. Ferrando, Arlington, VA (US); Mark M. Opeka, Laurel, MD (US); James A. Zaykoski, Mt. Airy, MD (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 480 days.

(21) Appl. No.: 15/914,702

(22) Filed: Mar. 7, 2018

(51) Int. Cl.
*B22F 9/16* (2006.01)
*B22F 9/04* (2006.01)

(52) U.S. Cl.
CPC ..... *B22F 9/16* (2013.01); *B22F 9/04* (2013.01); *B22F 2009/043* (2013.01); *B22F 2301/40* (2013.01)

(58) Field of Classification Search
CPC ..... B22F 2301/40
See application file for complete search history.

(56) References Cited

U.S. PATENT DOCUMENTS 3,206,217 A 9/1965 Shepard et al.
4,265,661 A 5/1981 Ware
5,942,057 A 8/1999 Hanamura et al.
5,972,133 A 10/1999 Kambara
6,042,777 A * 3/2000 Lo ..... C22C 1/0491 419/48
7,213,776 B2 5/2007 Dobbs
7,828,915 B2 11/2010 Lee et al.
7,854,912 B1 12/2010 Talmy et al.
8,114,807 B2 2/2012 Porter et al.
9,755,229 B2 * 9/2017 Wang ..... C22B 25/04
(Continued)

OTHER PUBLICATIONS

"Crucible", Encyclopaedia Britannica, Nov. 24, 2011, https://www.britannica.com/technology/crucible, Access Date: Oct. 6, 2020 (Year: 2011).*

(Continued)

*Primary Examiner* — Stefanie J Cohen
*Assistant Examiner* — Christopher D. Moody
(74) *Attorney, Agent, or Firm* — Howard Kaiser

(57) ABSTRACT

An inventive method is provided for synthesizing an intermetallic compound. According to exemplary inventive practice, two metallic elements are weighed out in quantities corresponding to their molecular weights in an intermetallic compound of interest. The two metallic elements are mixed together to produce a metallic mixture in powder form. According to many inventive embodiments, a ball-mill device is implemented to thoroughly or intimately mix the two metallic elements into a fine powder. The powdered metallic mixture is exothermically reacted to produce an at least substantially pure intermetallic compound in powder form. According to many inventive embodiments, the exothermic reaction is brought about in a vacuous or inert-gaseous (e.g., helium) environment through electrification of a tungsten wire filament that is completely embedded in the powdered metallic mixture.

16 Claims, 8 Drawing Sheets

(56) References Cited

U.S. PATENT DOCUMENTS

| | | | | |
|---|---|---|---|---|
| 9,822,040 | B1 | 11/2017 | Martin et al. | |
| 2011/0091350 | A1* | 4/2011 | Haidar | C22C 1/02 420/420 |

OTHER PUBLICATIONS

"Ball Mill", Navjyot Engineering & Equipments Pvt. Ltd, retrieved from Wayback Machine Jul. 14, 2016, https://web.archive.org/web/20160714064252/http://navjyot.co.in/ball-mill.html, Access date Oct. 10, 2020 (Year: 2016).*

* cited by examiner

WEIGHTS OF POWDER CONSTITUENTS

| Example | Element | Gram Molecular Weight | Divided By | Division Quotient Weight (g) | Multiplied By | Multiplication Product Weight (g) |
|---|---|---|---|---|---|---|
| 1 | Tungsten (W) | 183.84 | 10 | 18.384 | 2 | 36.768 |
| | Zirconium (Zr) | 91.224 | 10 | 9.122 | 1 | 9.122 |
| 2 | Tantalum (Ta) | 180.947 | 40 | 4.525 | 3 | 13.575 |
| | Aluminum (Al) | 26.981 | 40 | 0.675 | 1 | 0.675 |
| 3 | Tin (Sn) | 118.710 | 20 | 5.925 | 3 | 17.775 |
| | Zirconium (Zr) | 91.224 | 20 | 4.561 | 5 | 22.805 |
| 4 | Hafnium (Hf) | 178.49 | 12 | 14.874 | 1 | 14.874 |
| | Aluminum (Al) | 26.981 | 12 | 2.248 | 3 | 6.744 |
| 5 | Aluminum (Al) | 26.981 | 6 | 4.497 | 2 | 8.994 |
| | Zirconium (Zr) | 91.224 | 6 | 15.204 | 1 | 15.204 |

FIG. 3

SYNTHESIS OF AN INTERMETALLIC COMPOUND POWDER

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

The present invention relates to intermetallic compounds, more particularly to methods, such as involving mixing and exothermic reaction, for producing powdered intermetallic compounds.

An intermetallic compound has been defined as "an intermediate phase in an alloy system, having a narrow range of homogeneity and relatively simple stoichiometric proportions, in which the nature of the atomic bonding can vary from metallic to ionic." *Metals Handbook, Volume 1: Properties and Selection of Metals,* $8^{th}$ Edition, American Society for Metals (ASM), page 21 (1961). Typically, the ratios of the metallic components of an intermetallic compound are simple whole numbers. For instance, the intermetallic compounds $ZrAl_3$ and $Ta_3Sn$ have elemental ratios of 1:3 and 3:1, respectively.

The variable character of the bonding characterizing an intermetallic compound suggests to the present inventors that certain intermetallic powders may be of beneficial use in various high temperature ceramic applications. It is therefore desirable to provide a simpler, more efficient, more economical method for producing intermetallic compound materials in powder form and with reasonable purity.

SUMMARY OF THE INVENTION

In view of the foregoing, an object of the present invention is to provide a new and improved methodology for producing unfused powdered intermetallic compounds, such as may be useful in very high temperature ceramic applications. For instance, inventively produced intermetallic compounds may be used as additives within, or as sintered materials for, very high temperature components.

Exemplary inventive practice provides method and apparatus for making an intermetallic compound in powder form. An exemplary inventive embodiment includes the steps of mixing two elemental metallic powders to form a bulk metallic mixture powder, and heat-reacting the bulk mixture powder in a vacuum or helium environment to form an intermetallic compound powder.

As exemplarily practiced, the inventive method succeeds in producing batches of unfused, largely single-phase intermetallic powders. The present invention affords great benefit in its ability to produce single-phase intermetallic materials, particularly in view of the quite limited commercial availability of materials of this nature. Since conventional demand for intermetallic powders is very small, it is unlikely that any company or foundry would make such intermetallic powders available except on special order and at high cost.

A conventional process of producing single-phase intermetallic materials of this kind would leave much to be desired, as it would involve a melting of the ingots of the component metals in the correct stoichiometric proportions while thoroughly mixing. After slowly cooling, the alloy would be finely ground with suitable equipment. This conventional approach to making an intermetallic compound can be problematical because of the inconvenience and cost of ingot melting as well as the additional cost and possible contamination during the grinding process. By comparison, the process of the present invention largely overcomes the drawbacks associated with conventional practice.

Exemplary inventive practice effectuates exothermic reaction synthesis (combination) of intermetallic powder phases, at least some of which may be suitable for application to high temperature materials. There are two main components of exemplary practice of the present invention's method for producing high quality single-phase intermetallic powders. First, metallic constituents (or constituents including metallic constituents) are suitably mixed (such as via ball-milling) to form a bulk mixture material. Second, the bulk material is subjected to a heat of reaction that is nonexplosive and sustainable throughout the bulk mixture material.

According to exemplary inventive practice, the reaction heat is produced in the bulk mixture by energizing a tungsten filament that is embedded in the bulk mixture. As exemplarily embodied, the inventive method includes embedment of the tungsten filament entirely beneath the surface of the surrounding medium; that is, the tungsten filament is immersed, submerged, or buried in the bulk mixture. Nevertheless, practice of the present invention is possible whereby the heat reaction of the bulk mass powder is brought about in another way, such as by applying high-temperature heat to a bulk mixture situated inside a furnace.

The first major element of exemplary inventive practice is an intimate mixing of the constituents to form the bulk material. Exemplary inventive practice involves ball-milling, which is a generally reliable known technique used in metallurgy for thoroughly mixing powders. Ball-milling typically implements a device having a suitable hard-walled container (e.g., having a cylindrical shape), which is rotated with hard spheres (made of alumina, stainless steel, chrome steel, ceramic, rubber, or other suitable grinding medium) and the powders within. An intimately mixed combination of the individual powders is thus produced after a sufficient period of rotation of the ball-mill device. The softer material powder can become coated or smeared over the harder constituent, which increases the beneficial intimate mixing.

Many metallic elements are commercially available in fine powder form. In conducting their testing of the present invention, the present inventors procured fine elemental metallic powders of interest. Elemental metallic powders generally are commercially available as −325 mesh (or about 35p particle size), and sometimes in the 1-10μ range. The binary phase diagrams were used by the present inventors to identify intermetallic phases of possible use for high temperature application. Those intermetallic materials of interest generally have melting points greater than 1500° C., but more preferably in a range of near or above 2000° C.

The second major element of exemplary inventive practice is non-explosiveness and sustainability of a heat of reaction (reaction heat) throughout the bulk material. Depending on the inventive embodiment, the sustained heat reaction may be effected in a reaction chamber either (i) under vacuum conditions or (ii) in a helium (He) atmosphere. A helium atmosphere is preferable to a vacuum for many inventive embodiments, as the helium tends to eliminate oxidation phases and to hence produce a purer product. In some inventive embodiments an inert gas other than helium, such as argon or nitrogen, may be used to fill the reaction chamber.

The terms "vacuum" and "evacuate" as used herein do not necessarily refer to a perfect vacuum. As a practical matter a perfect vacuum is unattainable, and hence these terms refer to substantially empty space such as evacuated to the highest degree possible by a vacuum pump or other mechanical device. The terms "fill" and "filled," as used herein to convey a filling of a reaction chamber with an inert gas such as helium, refer to putting an inert gas into a reaction chamber so that the inert gas at least substantially occupies the reaction chamber.

There appears to be a dearth of published data on the heats of reaction between specific elemental metals. In the literature, the present inventors found ranges of reaction heats for numerous carbides, oxides, sulfides and chlorides of about 10-100 Kcal/mole. See, e.g., *Handbook of Chemistry and Physics,* 66$^{th}$ Edition, Robert C. Weast, Editor, CRC Press, Inc., pages D85-D93 (1985). The present inventors experimentally demonstrated that this range of energy content—viz., 10 through 100 Kcal/mole—is suitable for many embodiments of inventive practice. This range of reaction heats produces sufficient combustion for a sustained reaction throughout bulk material, with minimal danger of explosive combustion. Energy contents below this range are believed by the present inventors to be insufficient to complete the bulk reaction, at least in the majority of inventive embodiments.

BRIEF DESCRIPTION OF THE DRAWINGS

The present invention will now be described, by way of example, with reference to the accompanying drawings, wherein:

FIG. 3 is a tabular representation of respective weights of the two powder constituents mixed together to form the powder bulk material. The values set forth in the table of FIG. 3 are for each of five examples of inventive practice that are described hereinbelow.

DESCRIPTION OF EXEMPLARY EMBODIMENTS OF THE INVENTION

Figure 1:
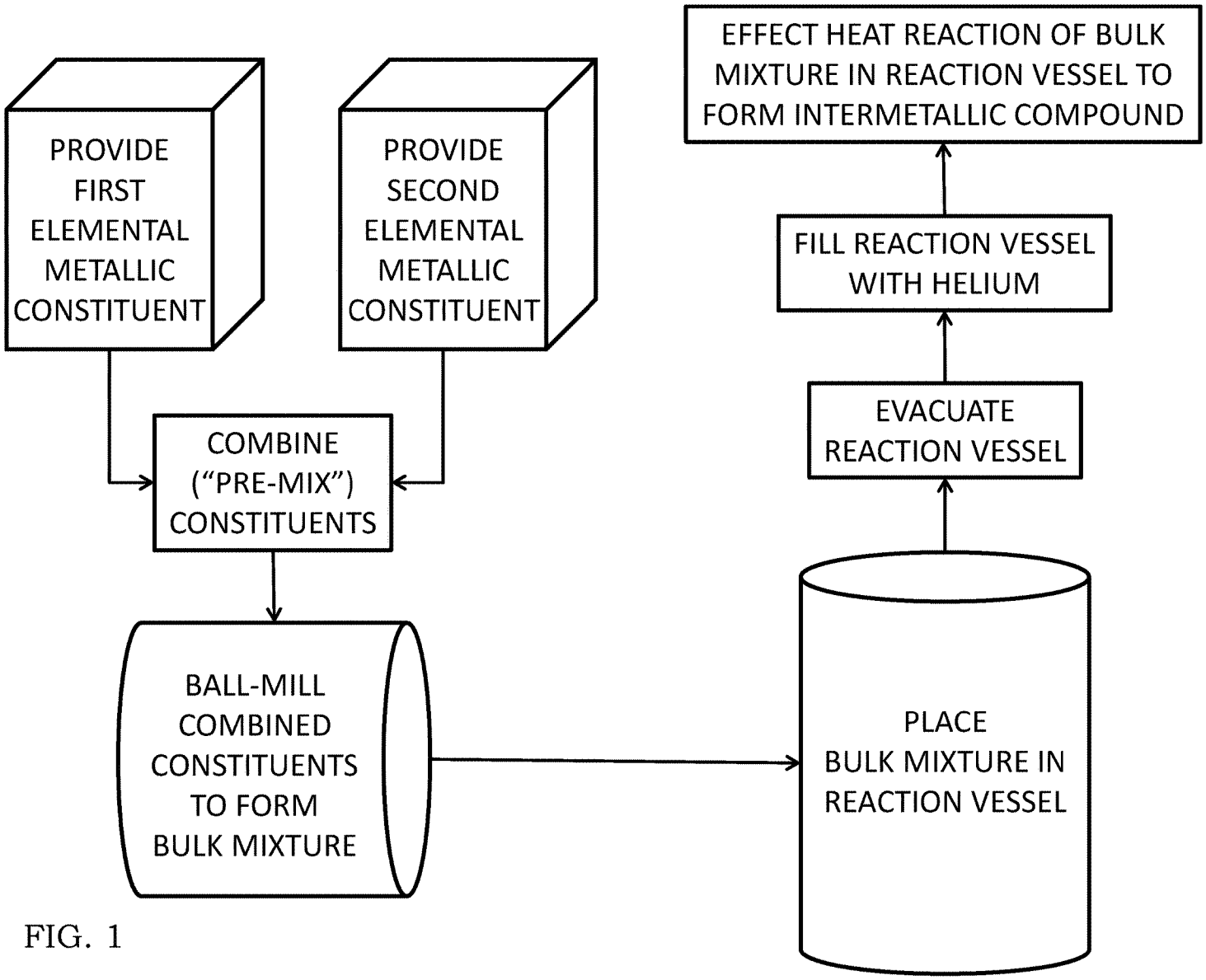
FIG. 1 is a flow diagram of an exemplary embodiment of a method, in accordance with the present invention, for making an intermetallic compound powder.
Figure 2:
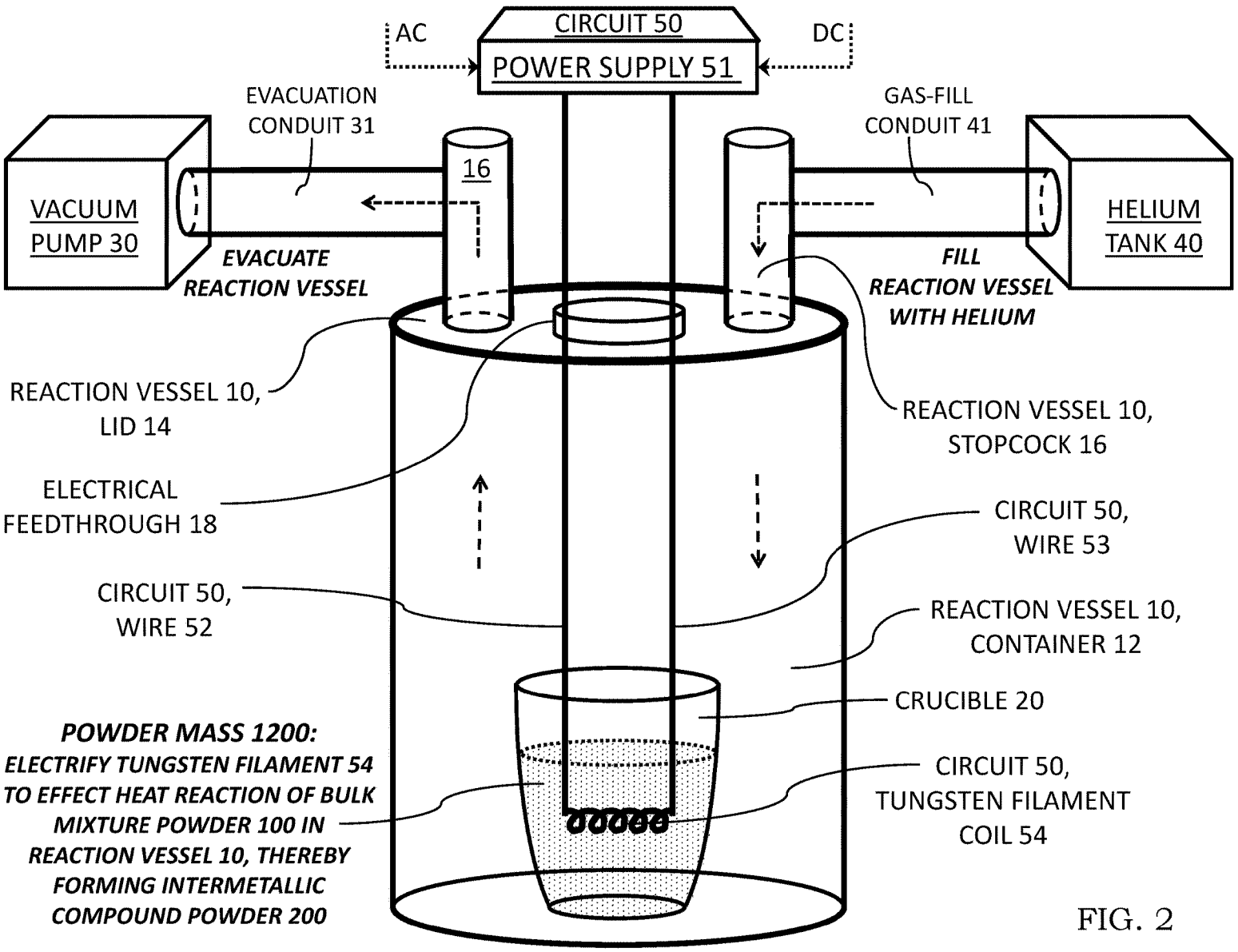
FIG. 2 is a schematic of an exemplary embodiment of an apparatus, in accordance with the present invention, for making an intermetallic compound powder.

Referring now to FIGS. 1 through 3, the present inventors conduced testing with respect to five different pairs of elemental metallic constituents. Each pair of elemental metallic constituents corresponds to one of the five examples of inventive practice that are discussed hereinbelow. The present inventors identified several compounds of interest, including the subjects of their testing, as possible candidates as additives for improving properties in existing high temperature ceramic materials. X-ray spectra were taken by the present inventors of their product compounds, and these X-ray spectra demonstrated the efficacy of their inventive method.

A preferred inventive method for making an intermetallic compound powder includes ball-milling two elemental powders into a fine powder mixture, followed by igniting the fine powder mixture so as to sustain a heat reaction of the powder mixture. Inventive ignition of a powder mixture may be somewhat analogous to squib ignition of charges. In keeping with inventive principles, many variations and refinements may be made in diverse inventive embodiments with respect to the mixing of the individual elemental constituents (e.g., including ball milling) and/or with respect to the producing of the heat reaction of the mixed elemental constituents (e.g., involving ignition of the mixed elemental constituents). For instance, two elemental metallic powders, or three or more elemental metallic powders, can be mixed together to form a bulk powder mixture.

With respect to each of the five tested pairs of elemental metallic constituents, a combination thereof in terms of their respective weights was defined. The two individual elemental powder constituents were weighed, with reasonable exactitude, in the proper ratio in fractions of gram molecular weights (MW). As indicated in FIG. 3, this weighing was performed with respect to each pair of constituents such that the total weight of the combined constituents was in the approximate range of 20 to 60 grams, thereby matching the size of the reaction vessel (e.g., desiccator jar) to be used, such as represented by reaction vessel 10 in FIG. 2. The two weighed-out elemental metallic constituents were combined, and were then ball-milled together for an extended period, using a commercially available ball-mill device.

The initial combining of the elemental metallic constituents represents, in a sense, a "pre-mixing" of these constituents, insofar as this combining of the constituents is preparatory for a thorough mixing of the constituents (such as via ball-milling). A mere "bringing together" of the constituents is usually sufficient at the "pre-mixing" stage, in view of the thorough mechanical mixing to be subsequently effected by a ball mill or other mixing device. The "pre-mixing" can be performed merely by individually transferring the constituents to the same mixing device (e.g., ball mill).

As diagrammatically illustrated in FIGS. 1 and 2, the present inventors designed and tested an inventive vacuum-fill-electrify system for making a powdered intermetallic compound material. The inventive apparatus depicted in FIG. 2 includes a reaction vessel 10, a crucible 20, a vacuum pump 30, an evacuation conduit 31, a helium tank 40, a gas-fill conduit 41, an electrical power supply 51, two electrical wires 52 and 53, and a tungsten filament 54. Reaction vessel 10 includes a container 12, a lid 14, at least one stopcock valve 16, and at least one electrical feedthrough 18. FIG. 2 depicts two stopcocks 16 and one feedthrough 18.

Electrical circuit 50 includes alternating-current (AC) or direct-current (DC) power supply 51, wires 52 and 53, and tungsten filament 54. Power supply 51 includes, or is characterized by or associated with, an AC or DC energy source. The combination including reaction vessel 10, wires 52 and 53, and filament 54 bears some similarity to a conventional incandescent light bulb. Generally speaking, an incandescent bulb is an inefficient producer of light but an efficient producer of heat. Although tungsten is usually the preferred material of conductive wire filament 54 in inventive practice, other materials may be suitable that are electrically conductive and have a high melting point, such as carbon, platinum, molybdenum, tantalum, and osmium.

Conduit 31 connects vacuum pump 30 to a stopcock 16. Conduit 41 connects helium tank 40 to the same or a different stopcock 16. Wire conductors 52 and 53 are fed through vacuum-pressure feedthrough 18, which is shown in FIG. 2 to be geometrically coaxial with cylindrical container 12. Lid 14, together with valve(s) 16 and feedthrough(s) 18, hermetically seals container 12. Reaction vessel 10 may include, for instance, a heavy glass vacuum desiccator jar or other transparent heat-resistant sealable enclosure or vacuum chamber. Crucible 20, used for containing the powder during heat-activated conversion from a powder mixture to an intermetallic powder compound, is situated inside reaction vessel 10 at the bottom of container 12. The crucible may be made of a metallic, ceramic, or other suitable refractory or heat-resistant material.

Multifarious kinds and configurations of reaction vessel 10 are possible in inventive practice, for instance in terms of: the sizes, shapes, and materials of the reaction vessel and of the crucible; the types, numbers, and arrangements of valves, feedthroughs, and/or apertures in the reaction vessel; presence or absence of removable parts such as lids, etc. The reaction vessel can have practically any geometric shape, e.g., prismatic, cylindrical, spheroidal, conical, irregular, etc. Although two stopcocks 16 and one feedthrough 18 are shown by way of example in FIG. 2, the ordinarily skilled artisan who reads the instant disclosure will appreciate that a reaction vessel 10 may include practically any number, types, and arrangement of devices, such as valves and feedthroughs, that are suitable for inlet and outlet with respect to reaction vessel 10. For instance, since according to exemplary inventive practice the reaction vessel 10 is evacuated and subsequently filled with helium, a single stopcock 16 may be used sequentially for both operations.

The term "powder mass," as used herein in the context of inventive practice, refers to a single powder entity that is at first composed of bulk mixture powder 100, then undergoes a heat reaction when subjected to intense heat from tungsten filament 54, and is finally composed of intermetallic compound powder 200. Powder mass 1200 is the powder material as it exists throughout inventive processing, changing from a mixture to a compound via the reaction-heat methodology of the present invention.

In the inventive testing that was conducted, wires 52 and 53 were fed through the vacuum-sealed feedthrough 18, and were connected outside reaction vessel 10 (e.g., a reaction jar such as a desiccator jar) to a variable autotransformer 51, which served as the electrical power supply for providing the requisite initiation voltage. The present inventors obtained a tungsten wire filament, 0.015" W wire diameter, from General Electric, Cleveland Wire Plant. Tungsten filament 54 was fashioned into a small coil and clipped into circuit 50 in connection with wires 52 and 53.

A ball-milled powder mixture 100 was placed inside ceramic crucible 20, which was then situated within reaction jar 10. Tungsten filament 54 was inserted into and situated below the surface of the ball-milled powder mixture 100 contained in the ceramic crucible 20, sitting inside reaction jar 10. Reaction vessel 10 was closed, and was then pumped down using a mechanical vacuum pump 30. Next, reaction vessel 10 was backfilled several times with helium gas from helium tank 40. The heat reaction of the powdered mass 1200 inside reaction vessel 10 was initiated and maintained by electrical circuit 50.

In their experimentation, the present inventors initially attempted several reactions in simple vacuum; however, the present inventors noted a moderate fraction of oxidation due to residual oxygen in the reaction vessel. It was determined by the present inventors that a helium atmosphere inside the reaction vessel largely eliminated the oxidation problem, particularly as the helium had the effect of "pushing out" the residual oxygen. Another advantage of the helium atmosphere is its high thermal conductivity, which promotes completion of the heat reaction.

Subsequent to the backfilling of reaction vessel 10 with helium, the tungsten filament ignitor 54 was energized slowly, increasing its temperature until the bulk mixture powder 100 reacted so as to transition to intermetallic compound powder 200. In most cases, the results were quite positive. The powder mass 1200 reacted completely with minimal fusing, retaining the powder form required for subsequent mixing with and sintering into high temperature ceramic materials.

Although small batches of intermetallic compound material 200 were synthesized according to the examples described in the instant disclosure, it will be apparent to the ordinarily skilled artisan who reads the instant disclosure that larger quantities of intermetallic compound material 200 can be produced in accordance with the present invention, such as involving use of a suitably sized reaction vessel 10.

With continued reference to FIGS. 1 through 3 and also with reference to FIGS. 4 through 8, several examples of inventive production of pure powdered intermetallic compounds 200 are described hereinbelow. In each of the following five examples of inventive practice, the present inventors used an x-ray spectroscopy technique, based on x-ray excitation, to characterize the intermetallic compound powder 200 in terms of its individual constituents. In Examples 1 through 3, the heat reaction took place inside a vacuum chamber. In Examples 4 and 5, the heat reaction took place inside a helium-filled chamber.

Example 1: Synthesis of $W_2Zr$

The phase diagram for tungsten-zirconium indicates only the intermetallic $W_2Zr$, with a melting point of 2210° C. Tungsten (W) and zirconium (Zr) have atomic weights of 184 and 91.2, respectively. In accordance with these atomic weight values, gram equivalent weight ratios of tungsten powder (1-2μ, 99% tungsten obtained from CERAC Specialty Inorganics) and zirconium powder (−325, 98.5% zirconium obtained from Alfa Aesar Research Chemicals, Johnson Matthey Company, 30 Bond St., Ward Hill, Mass.) were measured out in the manner indicated in the first pair of tabular rows of FIG. 3.

The tungsten powder and the zirconium powder were both placed into the ball milling device 10, and were ball-milled together for 24 hours. The elemental powder mixture 100 was then transferred to a crucible 20, which was then placed in the reaction vessel (vacuum jar) 10. A tungsten filament 54 was inserted in the reaction vessel 100 and positioned entirely within powder mass 1200, which at this point in time was elemental powder mixture 100. Reaction vessel 10, in a hermetically sealed state, was pumped out overnight using a mechanical vacuum pump 30 to about 30 millitorr of pressure.

Tungsten filament 54 was then energized to glowing, thereby igniting the powder mass 1200, which showed an obvious reaction front moving through the powder mass 1200. The duration of the energization of filament 54 varied among the examples described herein. According to exemplary inventive practice, filament 54 is electrified for a period of time in the range between approximately ten seconds and approximately thirty seconds, depending on the inventive embodiment. Inventive practice is also possible whereby filament 54 is heated from less than ten seconds or more than thirty seconds, again depending on the inventive embodiment.

The reaction vessel 10 was returned to atmospheric pressure and its contents removed. The powder mass 1200 remained largely in powder form after its heat reaction, and at this point in time was intermetallic compound powder 200. Accordingly, only slight grinding of intermetallic compound powder 200 was required subsequent to the heat reaction to produce a fine powder. Powder X-ray elemental analysis was performed on a portion of the intermetallic compound powder 200 product.

Figure 4:
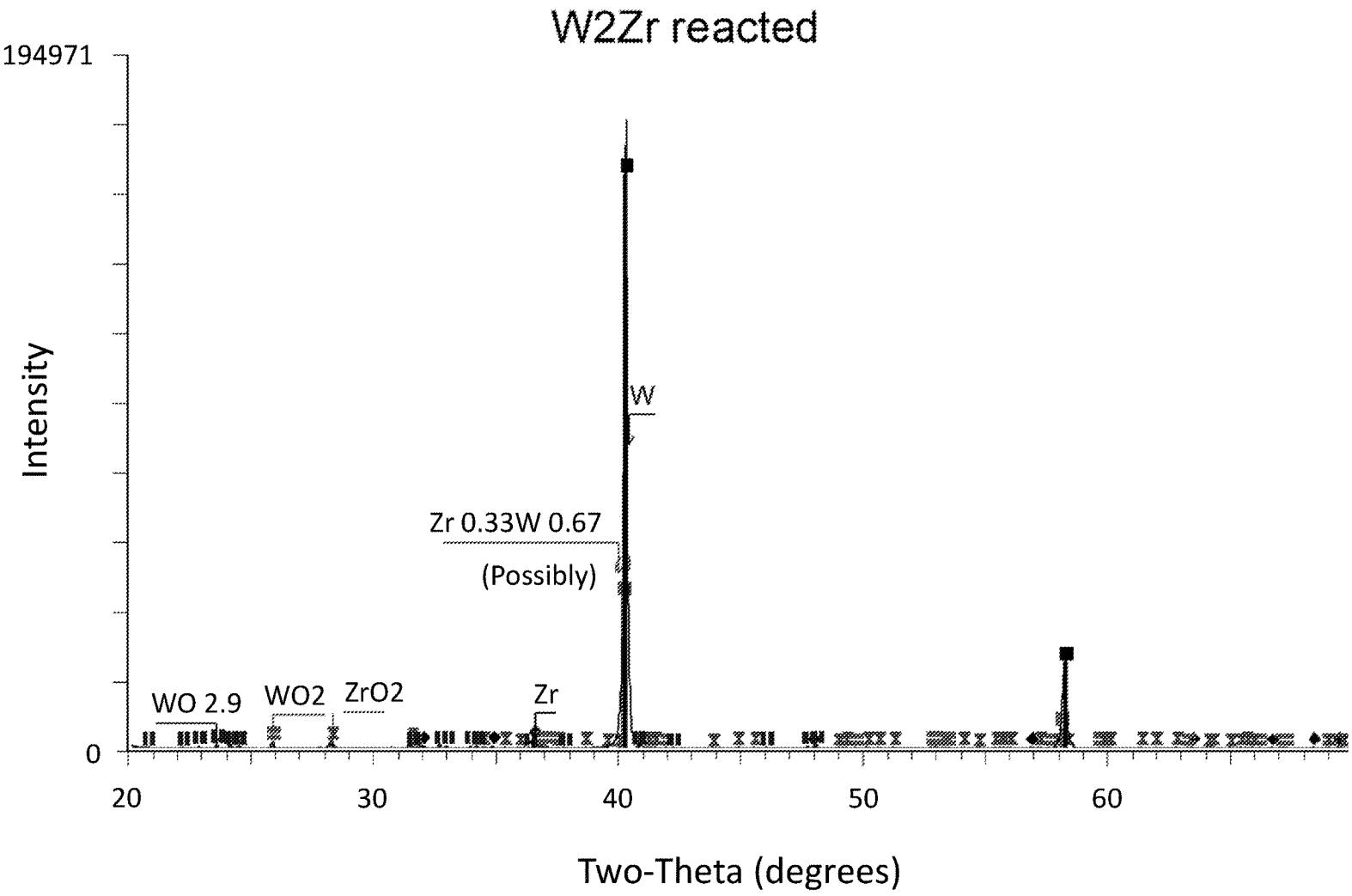
FIGS. 4 through 8 are graphical representations of respective x-ray emission spectra for the five examples of inventive practice. Each x-ray emission spectrum was analyzed by the present inventors to obtain qualitative data regarding the elemental composition of the bulk material.

The successful result of Example 1 is illustrated in FIG. 4. The data suggests that intermetallic compound powder 200 was (probably) composed of almost all $W_2Zr$, with minute amounts of Zr, $ZrO_2$, $WO_{2.9}$, and $WO_2$. It should be noted that the tungsten-zirconium phase diagram indicates $W_2Zr$ as the only intermetallic phase. This shows a melting point of about 2210° C.

Example 2: Synthesis of $Ta_3Al$

One phase diagram of tantalum and aluminum shows intermetallic phases at $Ta_3Al$ and $Ta_2Al$, with melting points of about 1550° C. and 2000° C., respectively. Another phase diagram shows a phase labeled a, centered around a composition of $Ta_{0.75}Al_{0.25}$ (equivalent to $Ta_3Al$), which melts around 2100° C. In an attempt to synthesize this latter phase, quantities of tantalum powder (−325, 99.9% Ta, obtained from Alfa Aesar Research Chemicals, Johnson Matthey Company) and aluminum powder (−325, 99.9% Al, obtained from Thiokol Propulsion R&D Laboratories) were measured out in the manner indicated in the second pair of tabular rows of FIG. 3.

The tantalum powder and the aluminum powder were combined in a ball-mill device and were ball-milled together overnight. The ball-milled mixture 100 was placed in a crucible 20 in the reaction vessel 10, which was equipped with tungsten filament 54. The reaction vessel 10 was pumped overnight via mechanical vacuum pump 30 to a vacuum of about 30 millitorr. In the vacuum atmosphere inside reaction vessel 10, the powder mass 1200 reacted slowly to initiation by the heated filament 54. The powder X-ray spectrum of the intermetallic compound powder 200 product is shown in FIG. 5.

Figure 5:
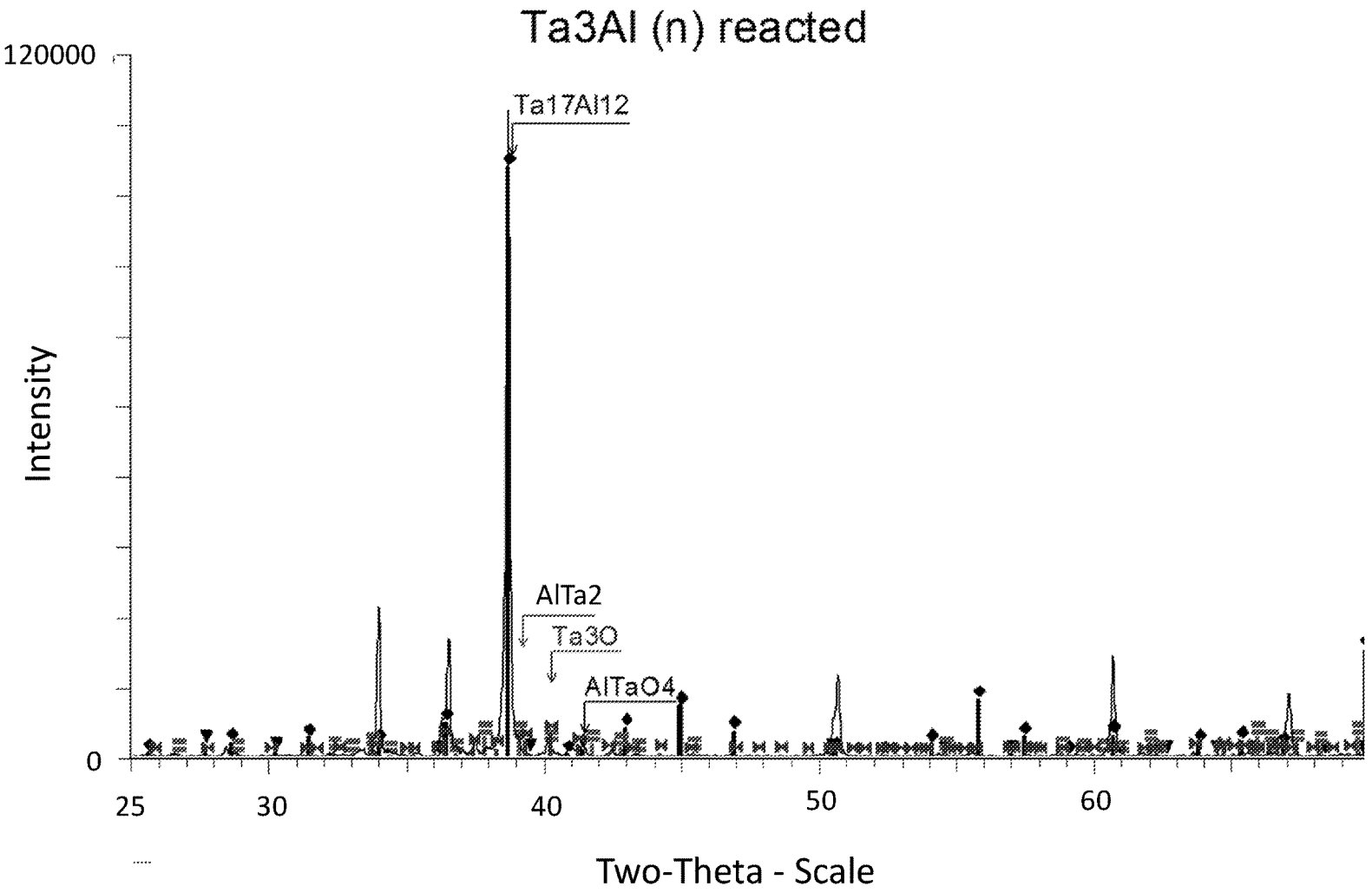

A good reaction between Ta and Al is evidenced by the data of FIG. 5. However, the data suggests the unexpected result that intermetallic compound powder 200 was primarily $Ta_{17}Al_{12}$, due possibly to Ta being consumed in the trace amounts $AlTa_2$, $Ta_3O$, and $AlTaO_4$.

Example 3: Synthesis of $Sn_3Zr_5$

The phase diagram of tin-zirconium shows the intermetallic $Sn_3Zr_5$ with melting point of 1988° C., as well as two other compounds $Sn_2Zr$ and $SnZr_4$. The present inventors measured quantities of tin powder (325, 99.9% Sn powder, obtained from Fisher Scientific Company, Fairlawn, N.J.) and zirconium powder (−325, 98.5% Zr obtained from Alfa Aesar Research Chemicals, Johnson Matthey Company) in the manner indicated in the third pair of tabular rows of FIG. 3. As indicated in FIG. 3, the gram molecular weight of the tin was about 118.71, and the gram molecular weight of the zirconium was about 91.22.

Figure 6:
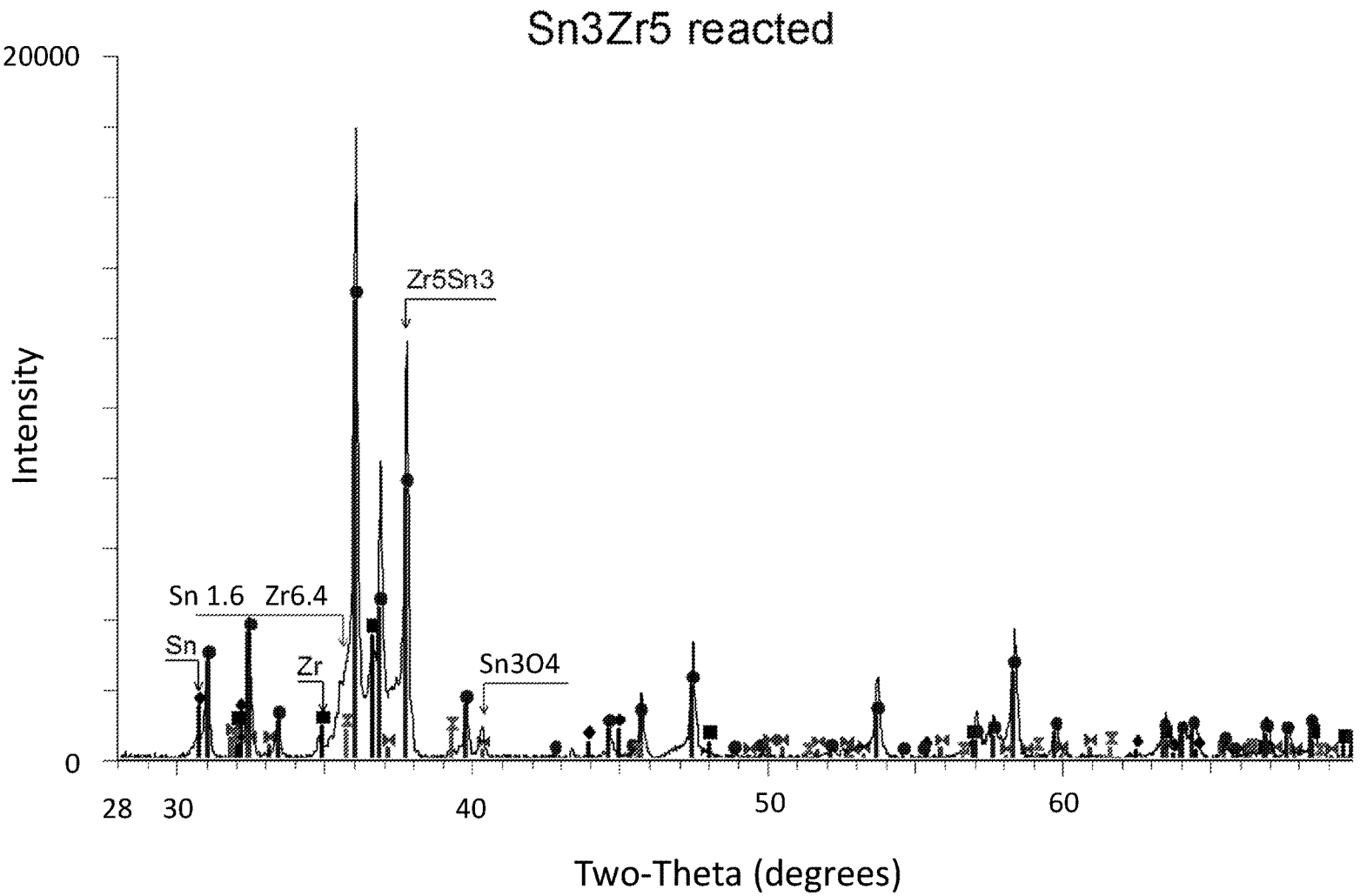
Figure 7:
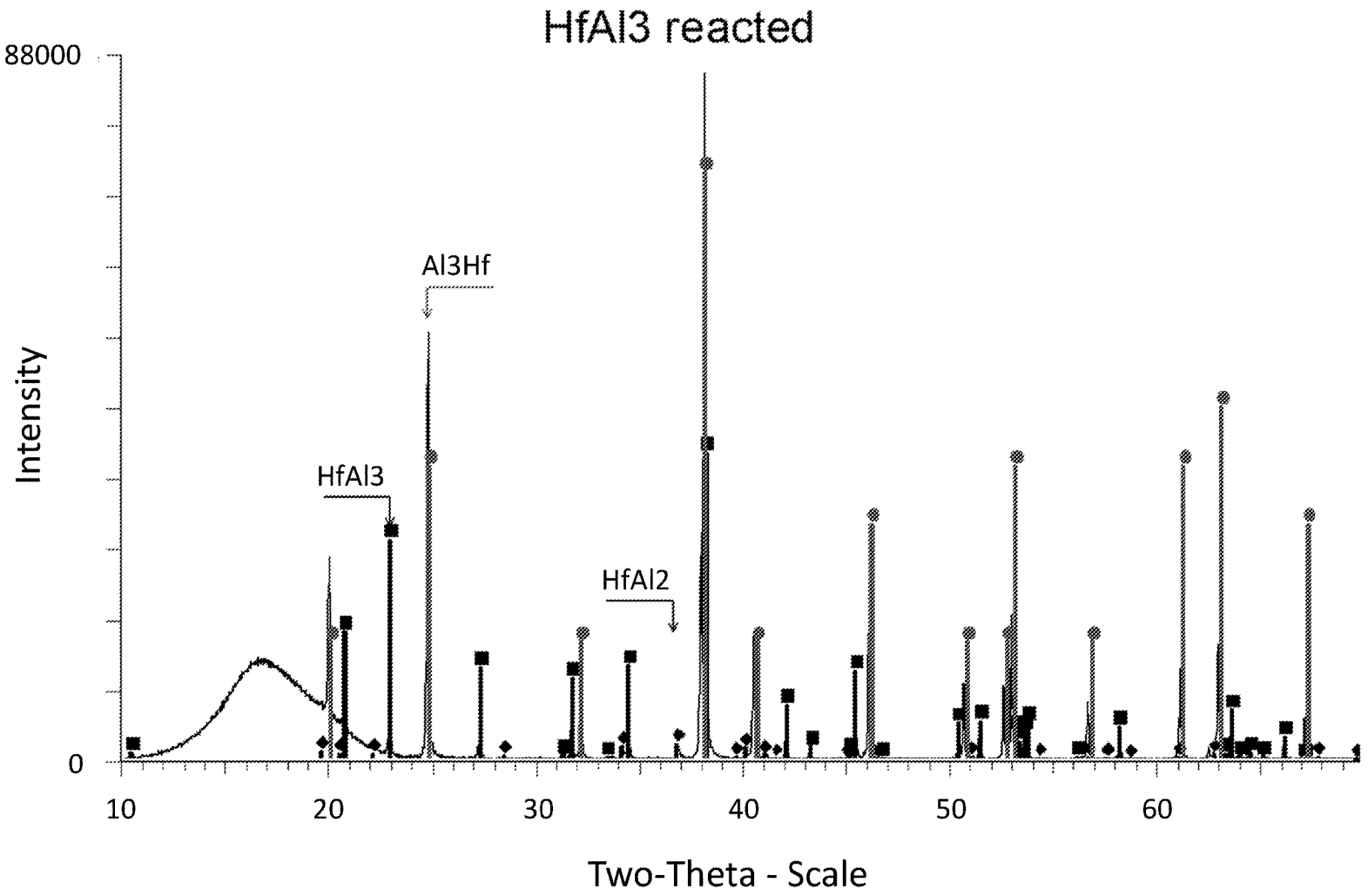

The powder constituents were combined and ball-milled for about 24 hours. The powder mass 1200 was then transferred to reaction vessel 10, which had tungsten filament 54 associated therewith. Reaction vessel 10 was pumped to about 30 millitorr, via mechanical vacuum pump 30. The powder mass 1200 was ignited by slowly increasing the temperature of tungsten filament 54 until reaction took place. The reaction appeared to be good and complete. A portion of the resultant intermetallic compound powder 200 was X-rayed. The accompanying spectrum is shown in FIG. 6.

The synthesis of intermetallic compound powder 200 was successful. The data indicated the presence of primarily $Zr_5Sn_3$, about 85%. There were also possible trace amounts of $Sn_{1.6}Zr_{6.4}$, unreacted Sn and Zr, and $Sn_3O_{4-}$ This sample was run following Example 2.

It should be emphasized that the respective heat reactions in Examples 1, 2, and 3 were performed in a vacuum. Some oxide was observed in both Example 2 and Example 3. In response to this detection of oxide, the present inventors considered the possibility of providing an inert gas fill. They concluded that, at least frequently in inventive practice, it would be preferable to provide an inert gas fill after a vacuum is pumped. The present inventors modified their apparatus accordingly in subsequent experimentation. Helium gas was selected by the present inventors for this purpose of affording a gaseous environment inside the reaction vessel 10. The helium serves to displace most of the residual oxygen, and should thus produce a purer product. Helium has the further advantage of a high thermal conductivity, which should help in achieving a complete reaction by augmenting the propagation.

Example 4: Synthesis of $HfAl_3$

The aluminum-hafnium phase diagram indicates the intermetallic compound $HfAl_3$, and also $HfAl_2$, HfAl, and others. The present inventors chose gram weight proportions for $HfAl_3$, which melts at −1600° C. Hafnium powder (−325, 99.8% Hf, obtained from CERAC Specialty Inorganics, Milwaukee, Wis.) and Al powder (−325, 99.9% Al, obtained from Thiokol Propulsion R&D Laboratories) were measured in proportion in the manner indicated in the fourth pair of tabular rows of FIG. 3.

The powders were combined and ball-milled for about 24 hours. The bulk mixture powder 100 was transferred from the ball mill to crucible 20, which was then placed, with powder mass 1200 contained therein, in reaction vessel 10. Electrical circuit 50 was set with filament 54 resting within the bulk mixture powder 100. Lid 14 was replaced upon container 12 so that reaction vessel 10 was hermetically sealed. Reaction vessel 10 was pumped down to approximately 30 millitorr, and then backfilled with helium gas. Reaction vessel 10 was then re-pumped and helium-backfilled a second time. The second helium fill was deliberately left somewhat below atmospheric pressure to allow for gas expansion due to heating during the reaction.

The result was a successful synthesis, viz., composed primarily of $Al_3Hf$, ~90%, with trace amounts of $HfAl_2$. As no oxide phase was detected, the helium gas was apparently effective in suppressing generation of oxide. The reaction was quite selective in producing $Al_3Hf$, considering the phase diagram indicates the nearby presence of other intermetallics.

Example 5: Synthesis of $ZrAl_2$

The aluminum-zirconium phase diagram indicates the intermetallic compositions ZrAl, $ZrAl_2$, $ZrAl_3$, and $Zr_5Al_3$, among others. The present inventors attempted to synthesize $Al_2Zr$ with melting point of 1647° C. Aluminum powder (−325, 99.9% Al obtained from Thiokol Propulsion R&D Laboratories) and zirconium powder ( )−325, 98.5% Zr obtained from Alfa Aesar Research Chemicals, Johnson Matthey Company) were measured out in the manner indicated in the fifth pair of tabular rows of FIG. 3.

The powders were combined and ball-milled for about 24 hours. The ball-milled powder 100 was placed in a crucible 20 and was transferred, while contained in crucible 20, to reaction vessel 10. An electrical circuit 50, including a tungsten filament 54, was associated with reaction vessel 10 whereby the tungsten filament 54 coil was completely buried inside the ball-milled powder 100. Reaction vessel 100 was pumped overnight to about 30 milli-torr, and was then backfilled with helium gas. These two steps were repeated; that is, for a second time, reaction vessel 10 was vacuum-pumped and then backfilled with helium gas. Following the second helium backfill, the heat reaction was initiated by applying an increasing voltage to the tungsten filament 54. The powder mass 1200 apparently reacted completely, with a glowing appearance.

Figure 8:
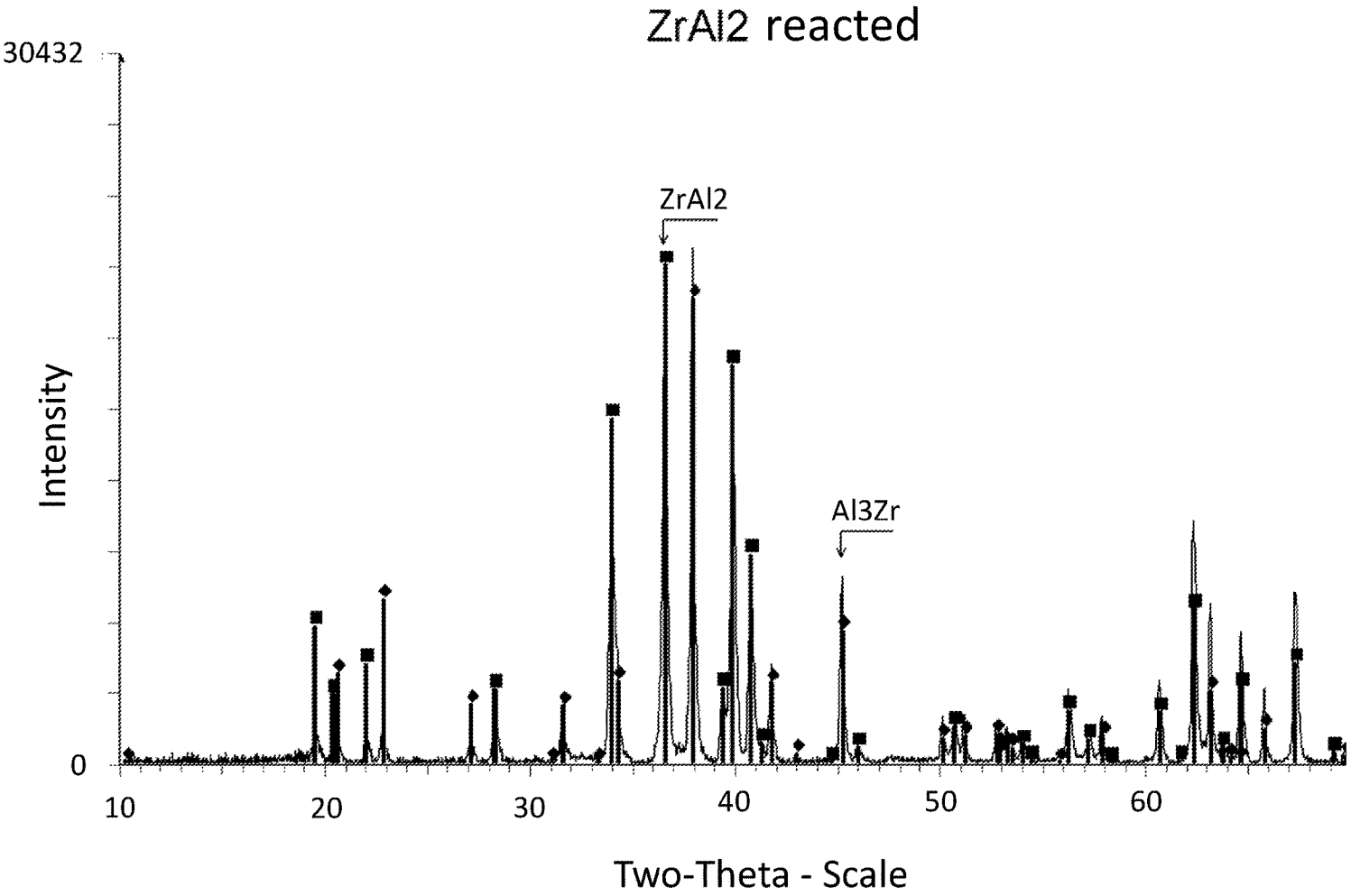

The X-ray powder spectrum taken is shown in FIG. 8. The result was a good reaction between zirconium and aluminum, with no apparent oxide component. The X-ray spectrum shows about a 60% proportion of $ZrAl_2$, with the balance being virtually all $ZrAl_3$.

The present inventors attempted synthesis of some other intermetallic compounds, such as $Nb_6Sn_5$, $Fe_2Zr$, and $TiMn_2$. However, these other attempts showed little to no reaction. The present inventors believe that these negative results were probably due to insufficiency of the heat content of the phase transformation to sustain a propagating reaction. On the other hand, the present inventors speculate that the heat content of the phase transformation should not be excessive. If the reaction heat content is too high, then the reaction product may split into several intermetallic fractions, similarly as but more excessively than was observed, to varying degrees, in the five above-described examples. Furthermore, many intermetallic compound powders not attempted to be made by the present inventors, for example $Si_3Ti_5$ powder, may be made through practice of the inventive methodology.

The present invention, which is disclosed herein, is not to be limited by the embodiments described or illustrated herein, which are given by way of example and not of limitation. Other embodiments of the present invention will be apparent to those skilled in the art from a consideration of the instant disclosure or from practice of the present invention. Various omissions, modifications, and changes to the principles disclosed herein may be made by one skilled in the art without departing from the true scope and spirit of the present invention, which is indicated by the following claims.

What is claimed is:

1. A method for making an intermetallic compound powder, the method comprising:

mixing a first metallic elemental powder and a second metallic elemental powder to form a metallic mixture powder;

placing said metallic mixture powder in a reaction vessel;

evacuating said reaction vessel;

effecting a heat reaction of said metallic mixture powder in said reaction vessel to form an intermetallic compound powder;

wherein said effecting of said heat reaction of said metallic mixture powder includes embedding an electrically conductive filament in said metallic mixture powder placed in said reaction vessel, and energizing said electrically conductive filament embedded in said metallic mixture powder so that said electrically conductive filament generates heat.

2. The method for making an intermetallic compound powder as recited in claim 1, wherein said mixing of said first metallic elemental powder and said second metallic elemental powder includes ball-milling together said first metallic elemental powder and said second metallic elemental powder to form said metallic mixture powder.

3. The method for making an intermetallic compound powder as recited in claim 1, wherein said placing of said metallic mixture powder in said reaction vessel includes putting said metallic mixture powder in a crucible and situating said crucible in said reaction vessel.

4. The method for making an intermetallic compound powder as recited in claim 1, further comprising filling said reaction vessel with helium, wherein said filling of said reaction vessel with helium is performed subsequent to said evacuating of said reaction vessel, and wherein said effecting of said heat reaction in said reaction vessel is performed in said reaction vessel filled with said helium.

5. The method for making an intermetallic compound powder as recited in claim 1, wherein said heat reaction of said metallic mixture powder includes exothermic reaction synthesis of said intermetallic compound.

6. The method for making an intermetallic compound powder as recited in claim 1, wherein said electrically conductive filament glows while said electrically conductive filament generates heat.

7. The method for making an intermetallic compound powder as recited in claim 6, wherein said mixing of said first metallic elemental powder and said second metallic elemental powder includes combining said first metallic elemental powder and said second metallic elemental powder in a ball-mill device, and using said ball-mill device to ball-mill the combined said first metallic elemental powder and said second metallic elemental powder, thereby forming said metallic mixture powder.

8. The method for making an intermetallic compound powder as recited in claim 6, wherein said heat reaction of said metallic mixture powder includes exothermic reaction synthesis of said intermetallic compound.

9. The method for making an intermetallic compound powder as recited in claim 6, wherein said electrically conductive filament is made of tungsten.

10. The method for making an intermetallic compound powder as recited in claim 9, wherein a duration of said energizing of said electrically conductive filament is in a range between approximately 10 seconds and approximately 30 seconds.

11. A method for making an intermetallic compound powder, comprising:

mixing a first metallic elemental powder and a second metallic elemental powder to form a metallic mixture powder;

placing said metallic mixture powder in a reaction vessel;

evacuating said reaction vessel;

providing said first metallic elemental powder;

providing said second metallic elemental powder;

wherein said mixing of said first metallic elemental powder and said second metallic elemental powder includes ball-milling, in combination, said first metallic elemental powder and said second metallic elemental powder, thereby forming said metallic mixture powder;

wherein said placing of said metallic mixture powder in said reaction vessel includes putting said metallic mixture powder in a crucible and situating said crucible in said reaction vessel;

wherein said effecting of said heat reaction of said metallic mixture powder is performed in a vacuum in said reaction vessel and includes embedding an electrically conductive filament in said metallic mixture powder placed in said reaction vessel, and energizing said electrically conductive filament embedded in said metallic mixture powder so that said electrically conductive filament generates heat;

wherein a duration of said energizing of said electrically conductive filament is in a range between approximately 10 seconds and approximately 30 seconds.

12. The method for making an intermetallic compound powder as recited in claim 11, wherein said first metallic elemental powder and said second metallic elemental powder are two different elements selected from the group consisting of tungsten, zirconium, tantalum, aluminum, tin, and hafnium.

13. The method for making an intermetallic compound powder as recited in claim 12, wherein said intermetallic compound powder is a compound selected from the group consisting of $W_2Zr$, $Ta_3Al$, $Sn_3Zr_5$, $HfAl_3$, and $ZrAl_2$.

14. A method for making an intermetallic compound powder, comprising:

mixing a first metallic elemental powder and a second metallic elemental powder to form a metallic mixture powder;

placing said metallic mixture powder in a reaction vessel;

evacuating said reaction vessel;

effecting a heat reaction of said metallic mixture powder in said reaction vessel to form an intermetallic compound powder;

filling said reaction vessel with helium, wherein said filling of said reaction vessel with helium is performed subsequent to said evacuating of said reaction vessel;

wherein said mixing of said first metallic elemental powder and said second metallic elemental powder includes ball-milling, in combination, said first metallic elemental powder and said second metallic elemental powder, thereby forming said metallic mixture powder;

wherein said placing of said metallic mixture powder in said reaction vessel includes putting said metallic mixture powder in a crucible and situating said crucible in said reaction vessel;

wherein said effecting of said heat reaction in said reaction vessel is performed in said reaction vessel filled with said helium and includes embedding an electrically conductive filament in said metallic mixture powder placed in said reaction vessel, and energizing said electrically conductive filament embedded in said metallic mixture powder so that said electrically conductive filament generates heat;

wherein a duration of said energizing of said electrically conductive filament is in a range between approximately 10 seconds and approximately 30 seconds.

15. The method for making an intermetallic compound powder as recited in claim 14, wherein said first metallic elemental powder and said second metallic elemental powder are two different elements selected from the group consisting of tungsten, zirconium, tantalum, aluminum, tin, and hafnium.

16. The method for making an intermetallic compound powder as recited in claim 15, wherein said intermetallic compound powder is a compound selected from the group consisting of $W_2Zr$, $Ta_3Al$, $Sn_3Zr_5$, $HfAl_3$, and $ZrAl_2$.

* * * * *